United States Patent [19]

Blaser et al.

[11] Patent Number: 4,546,752

[45] Date of Patent: Oct. 15, 1985

[54] PREMIXED CHARGE CONDITIONER FOR INTERNAL COMBUSTION ENGINE

[76] Inventors: Richard F. Blaser; Walter L. Blaser, both of 214 Pierce Ave., Cape Canaveral, Fla. 32920

[21] Appl. No.: 550,568

[22] Filed: Nov. 10, 1983

[51] Int. Cl.[4] ..... F02M 25/06

[52] U.S. Cl. ..... 123/568; 123/590

[58] Field of Search ..... 123/568, 571, 590

[56] References Cited

U.S. PATENT DOCUMENTS

| | | | |
|---|---|---|---|
| 1,539,126 | 5/1925 | Link | 123/568 X |
| 3,458,297 | 7/1969 | Anderson | 123/590 X |
| 3,498,274 | 3/1970 | Chapman | 123/590 X |
| 3,680,534 | 8/1972 | Chavant | 123/568 |
| 3,866,586 | 2/1975 | Scott, Jr. | 123/568 |
| 3,989,018 | 11/1976 | Beier | 123/568 |
| 4,112,892 | 9/1978 | Lindberg | 123/568 |
| 4,150,646 | 4/1979 | Aoyama et al. | 123/568 |

*Primary Examiner*—Parshotam S. Lall
*Assistant Examiner*—W. R. Wolfe
*Attorney, Agent, or Firm*—Bacon & Thomas

[57] ABSTRACT

A charge conditioner for an Otto cycle internal combustion engine supplies hot, oxygen-free exhaust gas to premixed intake fuel and air charge in sufficient quantity to heat the charge and completely vaporize the fuel, while improving engine volumetric efficiency by filling the cylinders with a mass of exhaust gases introduced downstream of the throttle. The flow of exhaust gas to the charge is maximum from idle to approximately cruise engine power output, and is then progressively decreased up to full engine output until flow is prevented at maximum engine power output. A supplemental fuel supply system optionally adds vaporized fuel to the charge by using the hot exhaust gas as a fuel carrier to the charge intake stream.

25 Claims, 7 Drawing Figures

FIG 3
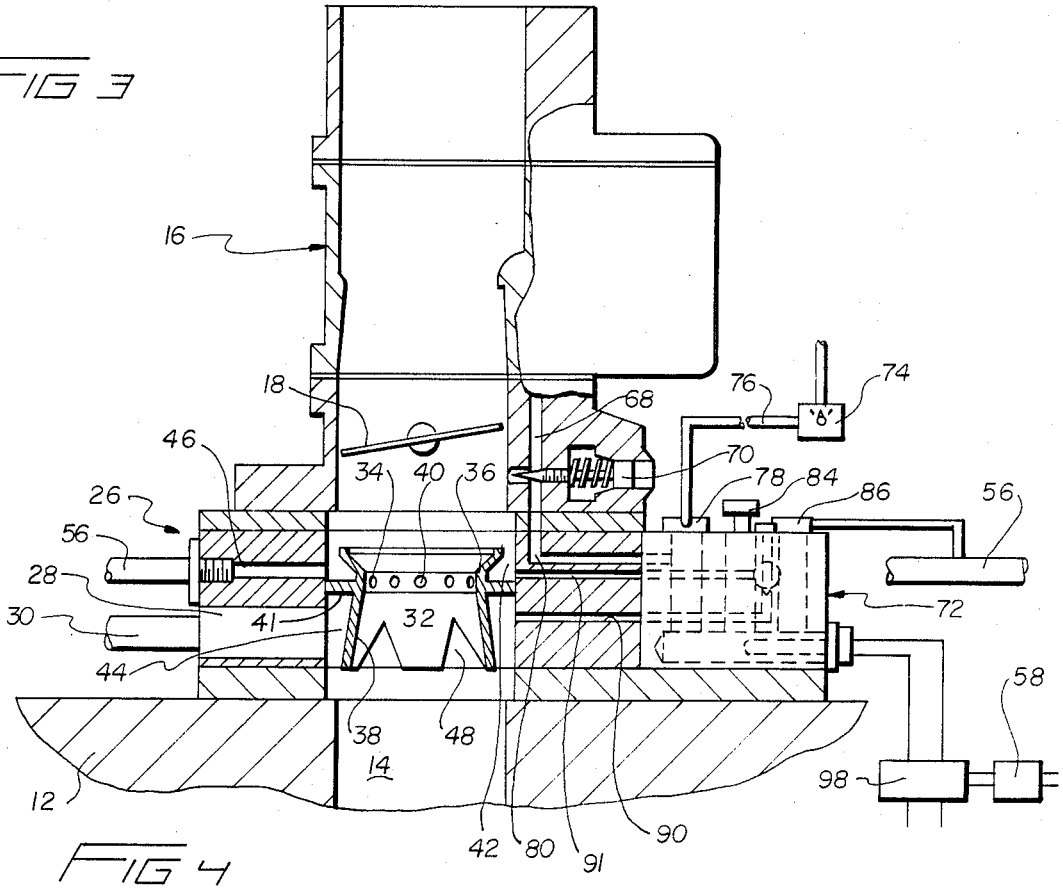
FIG 4
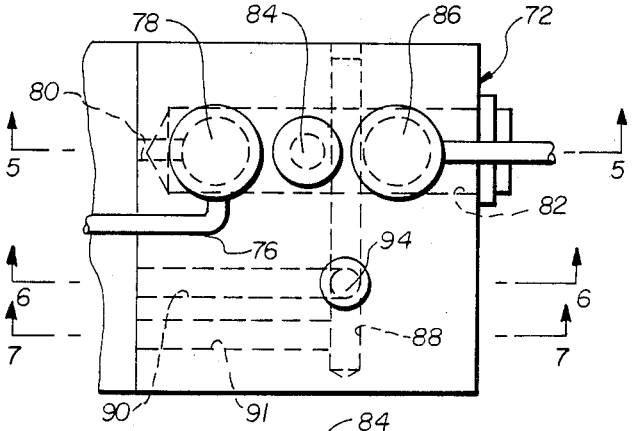
FIG 6
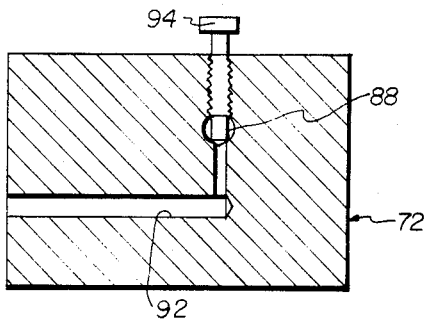
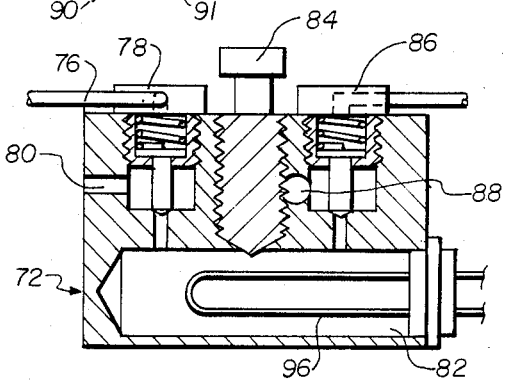
FIG 5
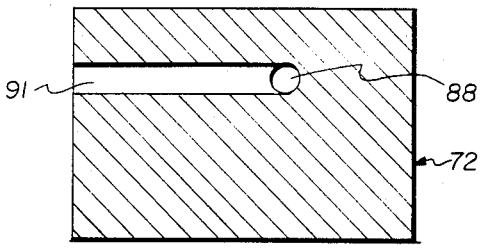
FIG 7

PREMIXED CHARGE CONDITIONER FOR INTERNAL COMBUSTION ENGINE

BACKGROUND OF THE INVENTION

1. Field of the Invention

This invention is in the field of Otto cycle internal combustion engines and in particular relates to apparatus for conditioning a premixed homogenous charge supplied to such engines.

2. Description of the Prior Art

Otto cycle internal compustion engines using normally liquid hydrocarbon fuels require that the fuel be vaporized in the intake airstream before reaching the combustion chambers of the engines. While complete vaporization of the fuel is necessary for enabling the engine to operate at maximum efficiency, in actual practice it has been observed that after the fuel has been added to the intake airstream, it may condense out on the walls of the intake manifold of the engine or may otherwise condense into droplets before reaching the combustion chambers. While the fuel/air charge is generally considered as being a homogenous mixture of the reactants, in actuality they can be considered more precisely as being constituted of air, fuel vapor, suspended minute fuel particles (droplets) and a liquid film of unvaporized or condensed fuel. Due to the different physical properties of these charge constituents, the rate of flow from the charge forming device, e.g., a carburetor, to each working chamber of the engine is varied, and results in different fuel/air proportions in different working chambers. This, as is generally recognized, produces less than desirable engine performance, including rough idling, misfire, poor economy and related problems that prevent the engine from achieving theoretical expectations for the fuel supplied in the charge.

To counteract these problems, various means are utilized in conventional internal combustion engines to provide heat to the intake manifold and still other refinements have been proposed by way of fuel charge preheaters that elevate the temperature of the charge before it reaches the combustion chambers of the engine. However, prior art heaters usually constitute heat exchangers and do not involve the admixture of another heated gaseous component into the charge stream to add heat to the charge to vaporize fuel.

It is also conventional to introduce exhaust gases into the charge intake stream of an internal combustion engine for the purpose of slightly diluting the charge to thereby reduce the temperature of the combustion zone in the working chambers of the engine during high load operation to reduce the generation of oxides of nitrogen ($NO_x$) which are an undesirable pollutant contained in engine exhaust gases. However, the maximum quantity of exhaust gases in such systems is comparatively small and the heat content thereof is insufficient to heat the intake charge to an adequate extent to thoroughly vaporize and condition the fuel, so that the basic problems associated with the supply of premixed, homogenous charges still remain even with such recirculating systems installed.

BRIEF DESCRIPTION OF THE INVENTION

The present invention contemplates adding hot exhaust gases under regulated flow conditions to the intake charge stream of an Otto cycle internal combustion engine under conditions whereby the exhaust gases are intimately mixed with a premixed charge of normally liquid fuel and air. The exhaust gases, tapped from the hottest area of the exhaust manifold of the engine and delivered to the intake manifold by a modulating and control system, are a source of heat and relatively oxygen-free gases which rapidly heat and vaporize the fuel component of the charge, and also add a mass of exhaust gases to the working chamber to improve engine efficiency by improving the filling of the working chambers during the intake events of the combustion cycles. The rate of flow of the exhaust gases is modulated so that the exhaust gases are supplied under modulated flow conditions to the intake charge stream from engine idle operation up through cruise engine torque load conditions. However, the flow of exhaust gases is also controlled so it progressively decreases as the engine operation proceeds from cruise torque load conditions to maximum torque load conditions. At approximately maximum engine torque load, the flow of exhaust gases is ceased altogether so that the charge intake stream is undiluted and maximum engine power is assured.

In accordance with the present invention, a charge conditioner utilizing hot exhaust gases as a source of heat is positioned in the intake manifold of the engine downstream of the charge forming system, conventionally a carburetor, and upstream of the engine intake ports. The premixed charge of reactants (fuel and air) is caused to be intimately blended with hot exhaust gases tapped from the engine exhaust manifold under vacuum modulated conditions by using an orifice restriction in the exhaust supply duct and a venturi passage in the charge conditioner through which the charge flows. The fluid kinetics resulting from the intake stream flowing through the orifice and the venturi passage generate and establish pressure imbalances and vacuum signals that modulate and control the flow of the hot exhaust gases into the intake charge stream. The supply of exhaust gas varies from a maximum flow rate at low engine load operating conditions, including idle, to zero flow as engine torque approaches maximum torque (open throttle). The fixed orifice in the exhaust supply line, with the other elements in the exhaust gas supply system, modulate the exhaust gas rate of flow under the lower output operating conditions, and a vacuum responsive valve is used to progressively reduce the flow of exhaust gas through the exhaust supply line at higher engine loads until flow is entirely stopped as maximum engine load operating conditions are approached. The vacuum responsive valve in the exhaust supply line is also used to block flow of exhaust gases into the intake stream during engine start up and while the exhaust gases in the supply duct are below a desirable operating temperature. This inherently allows the exhaust supply line to fill with exhaust gases before the contents of the exhaust supply line is opened to the charge conditioner.

The function of the basic charge conditioner is complemented by a supplemental fuel controller which stores and delivers fuel from the charge forming system, preferably via the idle fuel supply circuit of the system. The supplemental fuel controller provides supplemental fuel to the intake stream for enabling minor correction of the fuel-to-air ratio in the normal charge or for changing the fuel-to-air ratio altogether when a different fuel than that for which the carburetor is calibrated is used (e.g., converting from gasoline to alcohol fuel with a gasoline jetted carburetor). A heater (electrically operated, preferably) is provided in the supplemental fuel controller for improving starting and running of the engine while cold.

The supply of heat to the incoming charge from the hot exhaust gases assures complete and thorough vaporization of the fuel and permits the use of lower energy fuels, such as alcohol, in higher energy fueled (gasoline) engines while ensuring complete vaporization of any of the fuels supplied. The system in accordance with the present invention is particularly suited for use in a retrofit application for existing engines.

BRIEF DESCRIPTION OF THE DRAWINGS

FIG. 3 is an elevational cross sectional view of the charge conditioner in the system of FIG. 1;

FIG. 4 is a top view of the supplemental fuel supply system embodying the present invention;

FIG. 5 is a sectional view taken along line V—V of FIG. 4;

FIG. 6 is a sectional view taken along line VI—VI of FIG. 4; and

FIG. 7 is a sectional view taken along line VII—VII of FIG. 4.

DETAILED DESCRIPTION OF PREFERRED EMBODIMENT OF THE INVENTION

Figures 1, 2:
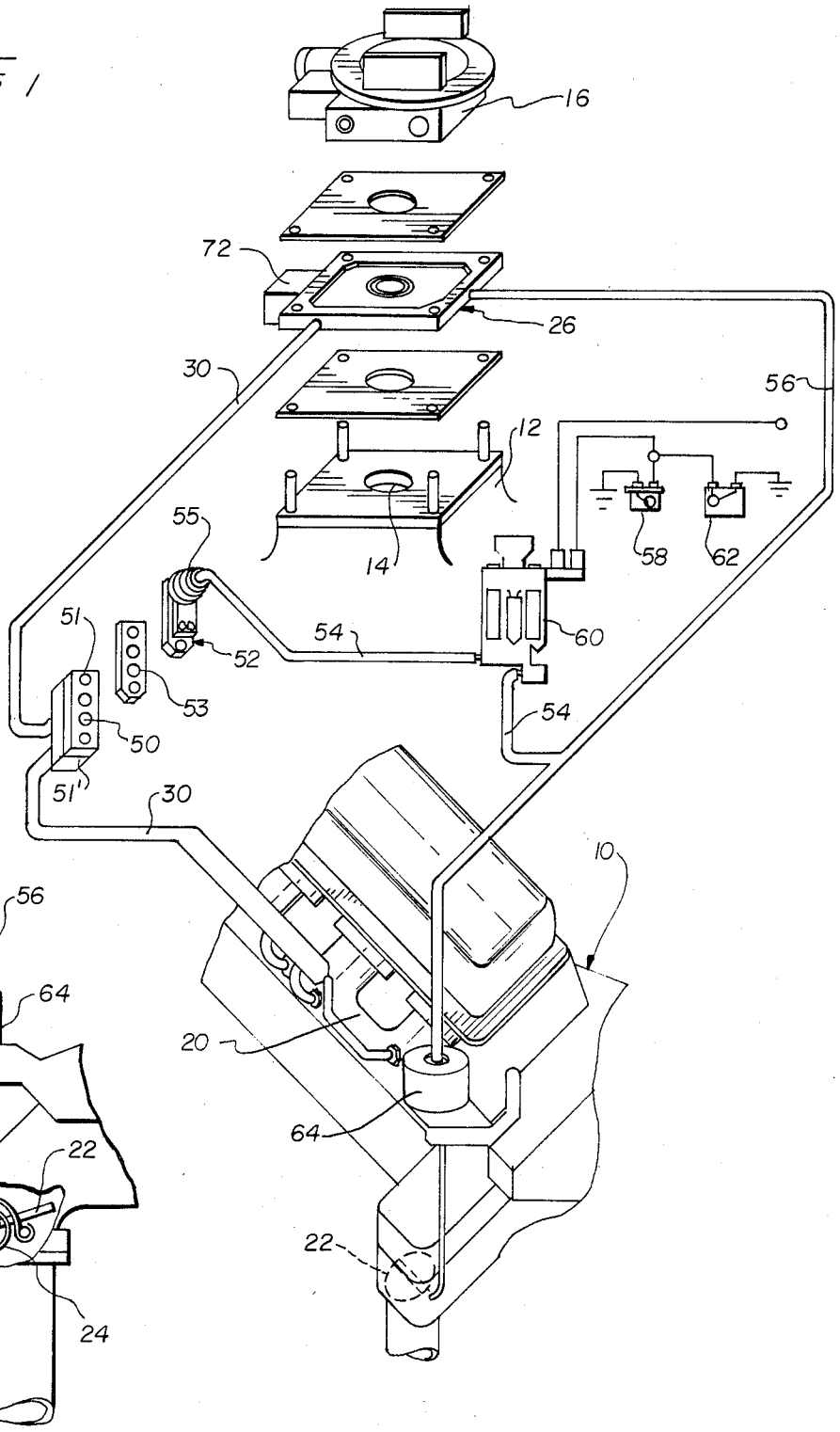
FIG. 1 is a schematic representation of a charge conditioner system embodying the present invention.
FIG. 2 shows the detail of the exhaust gas manifold valve in the system of FIG. 1.

With reference to the drawings, FIG. 1 is a schematic representation of the charge conditioner system constructed in accordance with the present invention. An internal combustion engine 10 includes a charge intake manifold 12 including a charge intake duct 14 through which flows a normally liquid hydrocarbon fuel and air charge that has been prepared by, for example, a carburetor 16. The engine 10 draws in a charge during its normal operational cycle through charge intake duct 14 (intake manifold), the pressure within which is normally below atmosphere due to the fact that a throttle such as throttle plate 18 (see FIG. 3) is normally provided in carburetor 16. The speed and output of the engine are controlled by positioning the throttle plate to regulate the quantity of charge admitted into the intake duct of the engine.

The engine 10 moreover is provided with an exhaust gas manifold 20 adjacent the exhaust port (not shown) of the engine. Flow of exhaust gases from the manifold 20 is controlled by means of a valve 22 that may be operated by means of a thermostatic spring 24 which controls the back pressure in the exhaust manifold 20 in a typical installation. Such valves are conventionally used to control the quantity of exhaust gases admitted to the intake manifold area of the engine for controlling the temperature of the intake manifold, particularly until the engine has reached full operating temperature.

With reference to FIGS. 1 and 3, the present invention comprises a charge conditioner system including a charge conditioning device generally shown at 26 (see FIGS. 1 and 3). The charge conditioner device 26 is intended to be mounted beneath the carburetor 16 between the throttle valve 18 and the charge intake duct 14 which communicates with the intake ports (not shown) of the engine 10. As seen in FIG. 3, the device 26 includes an exhaust gas inlet port 28 that communicates with an exhaust gas supply duct or conduit 30 that is connected to the exhaust manifold 20, as close to the engine exhaust ports as possible to ensure a supply of hot, oxygen-free exhaust gases from engine 10.

Within the device 26 there is provided a venturi body 32 through which all of the charge supplied to intake duct 14 flows. The venturi body 32 includes a venturi throat area 34, a diffuser area 36 and an expansion nozzle area 38. Suction ports 40 are provided in the throat area, the suction ports communicating with the area adjacent the diffuser area of the venturi body 32. Externally of the body 32 there is provided a laterally extending flange 41 which prevents flow of charge around the body 32, and divides the region externally of the body 32 into upper and lower chambers 42 and 44. It will be seen that flow of intake charge to the engine flows around the throttle plate 18 of the carburetor 16 and then primarily through the throat 34 of venturi body 32. The venturi body 32, of course, has a flow capacity at least as great as the carburetor 16 so it does not restrict the charge flow. A secondary portion of the charge flows around the exterior of the diffuser area 36 of the venturi body 32 and joins the primary intake stream through suction ports 40, which will create substantial agitation and turbulence in the primary charge intake stream flowing through the charge intake duct 14.

Engine intake manifold vacuum, of course, will be communicated to the upper chamber 42 and an intake vacuum signal will be generated within the upper chamber 42 due to the combined effects of the intake manifold vacuum and the charge flowing through the throat area 34. The vacuum signal in upper chamber 42 is communicated to the vacuum port 46 as seen in FIG. 3. The vacuum signal at port 46 is communicated by vacuum line 56 to vacuum operated actuator 64 that controls the position of a valve 22 in the exhaust manifold of the engine. A vacuum signals closes the usually open valve against the action of a spring 66, which action is compensated for by an engine exhaust temperature responsive thermostatic element 24. Until the vacuum input is strong enough, the spring 66 and thermostatic element 24 determine the setting of the valve 22, and thereby sustains the back pressure in exhaust manifold 20 which will drive the exhaust gases through exhaust gas supply duct 30. The actual rate of flow of exhaust gases is ultimately determined by the pressure difference between chamber 44 and nozzle 38 via apertures 48 in the nozzle. Thus, the amount of hot exhaust gases supplied to and mixed with the charge depends continuously on the interaction of the various events and fluidic forces described above so that an equilibrium state for all operating conditions is achieved.

Exhaust gases supplied through duct 30 are admitted to the lower chamber 44 in the expansion nozzle area 38 of the venturi body 32. Apertures 48 in the nozzle area 38 a supply of exhaust gases in chamber 44 to be drawn into the charge supply duct 14 in a desired proportion to increase the heat content of the charge considerably. This arrangement causes intimate mixing of the exhaust gases with the intake charge stream which is thereby conditioned by the heat and mass of hot oxygen-free gases in advance of the engine intake ports. The heat completely vaporizes the fuel and the mass of exhaust gases improves the filling of the cylinders of the engine which thereby improves its volumetric efficiency. The vaporization of the fuel, of course, improves engine operation, particularly with lower volatility fuels.

Since it is necessary to modulate the flow of exhaust gases supplied to the conditioning device 26 at various engine speeds and loads, an orifice 50 of predetermined cross sectional area determined for each engine size (displacement) is provided in the exhaust gas supply duct 30 to cooperate with the venturi passage and the exhaust supply system for enabling the flow of exhaust gases to be modulated in response to engine operating conditions. As seen in FIG. 1, the orifice 50 is also associated with a normally closed vacuum control valve 52 that is responsive to the vacuum in vacuum port 46 of the charge conditioning device 26, via vacuum duct 54 and 56, which are in communication with the vacuum port 46 of the device 26. The vacuum valve 52 includes a port 53 that is larger in cross sectional area than the orifice 50, which preferably is an interchangeable calibrated orifice in a plate 51 mounted on a valve body 51' between body 51' and vacuum controlled valve 52, 53. Flow through the port 53 is regulated by a vacuum operated actuator 55 that receives a vacuum signal from vacuum port 46 (FIG. 3) through lines 54, 56 and is arranged to shut off flow of exhaust gases through duct 30 when intake manifold vacuum of engine 10 is low (high torque loads), and permits full flow of exhaust gases as intake manifold vacuum increases (higher vacuum), in response to lower engine loads. Thus, the normal rate of flow of exhaust gases is modulated by orifice 50 when valve 52 is fully open, but as valve 52 progressively closes the flow of exhaust gases is progressively restricted. For example, in the preferred embodiment, it is desired that the valve 52 be fully open until the absolute pressure in the intake manifold of the engine at the port 46 approaches approximately 65% of the absolute manifold pressure at full engine torque output, and is thereafter progressively closed as the intake manifold pressure (absolute) increases towards its full torque pressure until, at approximately 90% of full torque intake manifold pressure (absolute) the valve 52 is completely closed.

Thus, the rate of flow of exhaust gas to the intake manifold through the apertures 48 will be ultimately determined by the backpressure in the exhaust supply conduit 30 upstream of the orifice 50, the pressure drop across orifice 50, the vacuum condition (or absolute pressure condition) at chamber 44, the pressure drop across orifices 48, the vacuum condition at port 46 and the position of valve 52. In a specific example, a 1977 Model 225 cubic inch displacement "slant six" Chrysler Corporation engine installed in a Dodge Aspen was modified by using a charge conditioner constructed in accordance with this invention and an orifice size of 0.625 inches (1.5875 cm.) was found to function adequately to modulate exhaust gas flow in conduit 30 when valve 52 was fully open. The cross sectional area of the venturi throat 34 in this example was between 70–80% of the cross sectional outlet area of the standard carburetor used with this engine.

Flow control valve 52 is also controlled in response to engine exhaust temperature by means of temperature sensor 58 and a solenoid vacuum cutoff valve 60. In the preferred mode of operation, when the temperature in exhaust duct 30 is below a predetermined minimum temperature, the temperature sensor 58 will cause solenoid vacuum cutoff valve 60 to close, thereby cutting off communication between the vacuum control valve 52 and the vacuum signal duct 56. When the temperature in the duct reaches a threshold level, the solenoid valve 60 is opened, thereby permitting opening of the valve 52 by vacuum in lines 54,56.

The vacuum cutoff valve 60 is also controlled by the ignition control switch 62, which prevents opening of valve 60 when the starter is engaged so that valve 52 remains closed and full fuel flow from the carburetor is available to the engine without exhaust gases during starting conditions. The solenoid valve 60 is normally open in its nonenergized condition. The engine temperature sensor 58 is closed to permit energization of the valve 60 when the temperature in duct 30 is below the desired threshold limit. Another desirable objective in maintaining the control valve 50 in closed position when the engine is started is to prevent admission of air from the exhaust manifold and exhaust gas supply duct into the charge supply duct before the exhaust manifold and duct are filled with exhaust gases.

As shown in FIG. 3, the carburetor 16 will normally have an idle circuit generally indicated at 68 for providing idle fuel below the throttle plate 18 when the plate is in its idle position. Since the admission of exhaust gas into the charge supply duct 14 will tend to decrease somewhat the quantity of air flowing through carburetor 16, particularly during idle, it may be necessary to slightly adjust the idle flow of fuel by means of idle screw 70. In some instances, however, when it is desirable to utilize a fuel having a lower heating value than the fuel for which the carburetor 16 is calibrated, the present invention contemplates the provision of supplemental fuel to the charge supply duct 14 by means of a supplemental fuel controller 72.

The supplemental fuel controller 72 can be selectively operated via switch 74 to transfer additional fuel from idle circuit 68 to the charge supply duct 14 when the switch 74 is moved to the alternative fuel position (see FIG. 3).

When the switch 74 is moved to the alternative fuel position, in accordance with the preferred embodiment of this invention, a vacuum line 76 is placed in communication with a vacuum source to open a fuel inlet valve 78 in the supplemental fuel controller 72. Fuel from the idle circuit 68 is thus permitted to pass through the supplemental fuel inlet 80 into a lower heating chamber 82 in the controller 72. Flow of the fuel out of the heating chamber 82 is controlled by two enrichment valves 84 and 86. Enrichment valve 84 is used for low speed idle regulation while enrichment control valve 86 is controlled by vacuum from line 56 to provide progressive enrichment as manifold pressure decreases (increased throttle setting). Flow of fuel through enrichment valve 84, 86 progresses into a fuel manifold 88 where it is mixed with available exhaust gas supplied through exhaust inlet port 90, and the supplemental fuel mixture flows back to the upper chamber 42 of the device 26 via supplemental fuel port 91, where it is drawn into the charge. The exhaust inlet port 90 communicates with chamber 44 through exhaust transfer line 92 and the quantity of exhaust gases allowed to enter into manifold 88 is regulated by a tuning screw 94. A heater element 96 in chamber 82 is energized when the ignition is on and the engine is cold by means of a heater switch 98 controlled through the engine temperature sensor 58 (see FIG. 1).

The supplemental fuel controller 72 in operation receives fuel from the idle circuit of the carburetor through the supplemental fuel inlet 80 when the valve 78 is open. The fuel flows into the heater chamber 82 and, if the engine is cold, is vaporized by means of the heater 96 to provide a fully vaporized fuel in the manifold 88. The fuel from the manifold 88 is regulated by the enrichment valves 84, 86 to provide a desirable enrichment of fuel vapor to the upper chamber 42 in the conditioner device 26 via port 91. The use of the fuel vapor alone, of course, is only intended to provide an enrichment during starting conditions before hot exhaust gases become available in lower chamber 44. When the hot gases become available, they are transferred through transfer line 92 to the fuel manifold 88 in accordance with the quantity permitted by the setting of the tuning screw 94. The exhaust gases then become the vehicle for transporting the supplemental fuel into the upper chamber 42 of the conditioner device.

Thus, when a fuel having a lower energy content than the fuel for which the carburetor has been calibrated is used, the supplemental fuel controller 72 enables enrichment of the charge without modifying the carburetor, simply by controlling the supply of supplemental fuel which is received from the idle circuit of the carburetor. Moreover, the supplemental fuel controller 72 provides an additional enrichment of the charge upon start-up conditions by ensuring a supply of fuel vapor alone when the engine is cold. This is considered to be a desirable feature when lower volatility fuels that are more difficult to vaporize than, say, gasoline, are used under cold starting conditions.

The above description relates to a preferred embodiment of the invention and it is to be understood that various other modifications and arrangements within the knowledge of a person skilled in the art could be made without departing from the spirit and scope of the invention, which is defined in the claims below.

What is claimed is:

1. A process for conditioning a premixed liquid fuel and air charge supplied to the working chamber of an Otto cycle internal combustion engine that includes a charge supply duct, an exhaust conduit and a charge forming device including a throttle in the charge intake conduit comprising:

(a) supplying a premixed charge of mixed liquid fuel and air to the charge supply duct using the charge forming device;

(b) establishing a first vacuum signal at the charge supply duct proportional to engine intake manifold absolute pressure;

(c) supplying exhaust gases under pressure from the engine exhaust conduit to an exhaust gas supply conduit having a fixed orifice restriction of predetermined cross-sectional area downstream of the inlet thereof;

(d) drawing exhaust gas into the charge supply duct downstream of the fixed orifice;

(e) controlling the quantity of exhaust gas supplied to the charge supply duct by directly communicating the first vacuum signal to the exhaust gas supply conduit upstream of the fixed orifice via the exhaust gas supply conduit; and (f) further controlling the quantity of exhaust gas supplied to the charge supply duct by regulating the exhaust gas pressure upstream of the fixed orifice so that at least at low engine load operating conditions, including idle, engine exhaust gas pressure upstream of the fixed orifice is raised above normal in the exhaust supply conduit.

2. A process as claimed in claim 1, including:

(h) further controlling the quantity of exhaust gas supplied to the charge supply duct by a vacuum control valve (VCV) upstream of the fixed orifice in the exhaust gas supply conduit and regulating exhaust gas flow between the fixed orifice and the charge supply duct by means of said VCV;

(g) establishing a second vacuum signal in the charge supply duct indicative of absolute pressure therein;

(i) regulating the VCV in response to said second vacuum signal so that flow through the exhaust supply duct is unrestricted by the VCV at low to medium engine torque loads (i.e., up to about 65% of full load) but is progressively restricted and finally fully blocked from medium load to approximately full load (i.e., between 65% and 90% of full torque engine load).

3. A process as claimed in claim 2, including:

(i) further controlling the flow of exhaust gas supplied to the charge supply intake duct by causing said VCV to close if exhaust gas temperature in the exhaust gas supply conduit is below a predetermined threshold.

4. A process as recited in claim 3, including:

(j) further controlling the flow of exhaust gas supplied to the charge supply intake duct by causing said VCV to close during an engine starting procedure.

5. A process as claimed in claim 1, including:

(g) establishing said first and second vacuum signals by using a venturi body in said charge supply duct downstream of the throttle.

6. A process as claimed in claim 5, including:

(h) supplying exhaust gas to said charge supply duct through one or more aperture(s) in an expansion region of said venturi body while causing all the charge supply to flow through said venturi body.

7. A process as claimed in claim 6, including:

(i) establishing said first vacuum signal at a throat region of said venturi body, and said second vacuum signal at an expansion region of said venturi body downstream of a throat region.

8. A charge conditioner system for supplying exhaust gas to the intake fuel and air charge of an internal combustion engine to promote vaporization of the fuel component of the charge and improved volumetric efficiency, the engine including a charge supply duct communicating with an engine intake port or ports for supplying a charge prepared by a charge forming means to the port(s), a throttle means for controlling the flow of charge through the charge supply duct, and an exhaust manifold constituting the source of supply of exhaust gas, comprising:

an exhaust gas supply conduit having an inlet end in communication with the engine exhaust manifold and an outlet end in cmmunication with the charge supply duct;

a fixed orifice having a preselected cross-sectional area in the exhaust gas supply conduit for restricting full flow of exhaust gas passing through the conduit from the exhaust manifold to the charge supply duct;

exhaust gas pressure regulator means associated with the exhaust manifold for controlling the exhaust gas pressure in the exhaust gas supply conduit upstream of the fixed orifice;

means for controlling said exhaust gas pressure regulator in response to engine operating conditions;

a venturi body including a restricted throat disposed in the charge supply duct downstream of the throttle means, the venturi body arranged so that the intake charge passes primarily through the venturi throat, the venturi having a total flow capacity substantially equivalent to the flow capacity of the charge-forming means;

the outlet end of said exhaust gas supply conduit communicating with said charge supply duct downstream of said venturi throat;

whereby intake vacuum in the charge supply duct establishes an absolute pressure in the exhaust gas supply conduit downstream of the fixed orifice that is less than the absolute pressure established upstream of the fixed orifice by operation of the engine and by regulation of the exhaust gas pressure regulator to thereby draw exhaust gas into the charge supply duct in a controlled manner and to cause its intimate mixing with the charge intake.

9. A charge conditioner system as claimed in claim 8, said venturi body including an expansion nozzle area downstream of said throat; said expansion nozzle including one or more exhaust gas inlet orifices; said exhaust gas supply conduit being in communication with and terminating adjacent to said exhaust gas inlet orifices.

10. A charge conditioner system as claimed in claim 8, said exhaust gas pressure regulator comprising a controllable exhaust flow valve (EFV), and control means for controlling the EFV in response to engine load.

11. A charge conditioner system as claimed in claim 10, wherein said control means for said EFV in response to engine load includes means responsive to engine intake vacuum conditions in said charge supply duct.

12. A charge conditioner system as claimed in claim 10, wherein said control means for said EFV further includes means for controlling the EFV in response to exhaust gas temperature in the exhaust manifold.

13. A charge conditioner system as claimed in claim 8, including a supplemental fuel supply means for selectively supplying supplemental fuel to the charge supply duct, said supplemental fuel supply means including means for supplying a secondary engine exhaust gas stream to said charge supply duct and means for adding supplemental fuel to and intimately mixing same with said secondary exhaust gas stream.

14. A charge conditioner system as claimed in claim 13, said supplemental fuel supply means including means for varying the quantity of supplemental fuel added to said secondary exhaust gas stream; means for generating a load signal indicative of engine load conditions; means for communicating said load signal to said means for varying the quantity of supplemental fuel; said fuel quantity varying means being regulated by said load signal so that a greater quantity of supplemental fuel is added to the secondary exhaust gas stream during high engine load conditions than at low engine load conditions.

15. A charge conditioner system as claimed in claim 14, said charge forming device comprising a carburetor having an idle fuel circuit; said supplemental fuel supply means including a supplemental fuel conduit in communication with said idle fuel circuit, said supplemental fuel conduit arranged to supply all the supplemental fuel to the means for adding supplemental fuel to the secondary exhaust gas stream.

16. A charge conditioner system as claimed in claim 15, said supplemental fuel supply means including a selectively operable heater element for vaporizing supplemental fuel supplied to said supplemental fuel supply means, the latter being arranged to supply vaporized supplemental fuel to the charge supply duct during engine start up and cold idle opertion.

17. A charge conditioner system as claimed in claim 8, including a vacuum signal port communicating at its inlet end with said charge supply duct downstream of said throttle means and upstream of said throat of said venturi body.

18. A charge conditioner system as claimed in claim 17, said venturi body and vacuum signal port disposed in and supported by a unitary housing.

19. A charge conditioner system as claimed in claim 17, said venturi body having an inlet diffuser area smaller than the area of the charge supply conduit and including one or more suction port(s) at said throat area providing communication between the venturi throat area and the external region of the venturi body;

an external partition on the venturi body on the downstream side of the suction port(s) for blocking the charge supply duct externally of the venturi body and causing all the charge to flow through the venturi body and said suction port(s);

said vacuum signal port disposed closely adjacent said Venturi body suction port(s) upstream of said partition.

20. A charge conditioner system as claimed in claim 19, including a normally closed vacuum control valve (VCV) for controlling flow through said exhaust supply conduit in addition to said fixed orifice, said VCV located between said fixed orifice and the charge supply duct and having a flow area therethrough that, when opened, is at least no less restrictive than the flow area of said fixed orifice; means for communicating a vacuum signal from said vacuum signal port to said VCV; said VCV arranged to be fully opened in response to a high vacuum condition at said vacuum signal port (low to medium engine torque load operating condition) and to be progressively closed in response to a lower vacuum condition in said vacuum signal port (high engine torque load operating condition) until the valve is fully closed at approximately maximum engine torque load operating condition.

21. A charge conditioner system as claimed in claim 17, including a normally closed vacuum control valve (VCV) for controlling flow through said exhaust supply conduit in addition to said fixed orifice, said VCV located between said fixed orifice and the charge supply duct, and having a throat area therethrough that, when open, is at least no less restrictive than the open cross-sectional area of said fixed orifice; means for communicating a vacuum signal from said vacuum signal port to said VCV; said VCV arranged to be fully opened in response to a high vacuum condition at said vacuum signal port (low to medium engine torque load operating condition) and to be progressively closed in response to a lower vacuum condition at said vacuum signal port (high engine torque load operating condition) until the valve is fully closed at approximately maximum engine torque load operating condition.

22. A charge conditioner system as claimed in claim 21, said VCV arranged to be fully opened until intake manifold absolute pressure reaches approximately 65% of the intake manifold pressure at full engine torque output and fully closed when intake manifold pressure reaches approximately 90% of the intake manifold pressure at maximum engine torque output.

23. A charge conditioner system as claimed in claim 21, including means for maintaining said VCV in closed position during engine start-up procedure, and means for maintaining said VCV in closed position until the temperature of exhaust gas in the exhaust gas supply conduit reaches a predetermined minimum temperature.

24. A charge conditioner system as claimed in claim 21, including means for maintaining said VCV in closed position during engine start-up procedure.

25. A charge conditioner system as claimed in claim 24, including means for maintaining said VCV in closed position until the temperature of exhaust gas in the exhaust gas supply conduit reaches a predetermined minimum temperature.

* * * * *